US009934651B2

(12) United States Patent
Watkins

(10) Patent No.: US 9,934,651 B2
(45) Date of Patent: Apr. 3, 2018

(54) GAMING MACHINE AND METHOD FOR PROVIDING PLAYER-SELECTABLE ENHANCEMENT SPOTS

(71) Applicant: Brian Watkins, Austin, TX (US)

(72) Inventor: Brian Watkins, Austin, TX (US)

(73) Assignee: Everi Games Inc., Austin, TX (US)

( * ) Notice: Subject to any disclaimer, the term of this patent is extended or adjusted under 35 U.S.C. 154(b) by 256 days.

(21) Appl. No.: 14/869,663

(22) Filed: Sep. 29, 2015

(65) Prior Publication Data

US 2017/0092066 A1 Mar. 30, 2017

(51) Int. Cl.

| | |
|---|---|
| ***G07F 17/00*** | (2006.01) |
| ***G07F 19/00*** | (2006.01) |
| ***G07F 17/32*** | (2006.01) |
| ***G07F 17/34*** | (2006.01) |

(52) U.S. Cl.

CPC ..... *G07F 17/3258* (2013.01); *G07F 17/323* (2013.01); *G07F 17/3262* (2013.01); *G07F 17/34* (2013.01)

(58) Field of Classification Search

CPC .. G07F 17/3258; G07F 17/32; G07F 17/3227; G07F 17/323; G07F 17/3244; G07F 17/326; G07F 17/3262; G07F 17/3267; G07F 17/34

See application file for complete search history.

(56) References Cited

U.S. PATENT DOCUMENTS

| | | | | |
|---|---|---|---|---|
| 6,004,207 | A * | 12/1999 | Wilson, Jr. | G07F 17/3244 273/143 R |
| 7,094,148 | B2 * | 8/2006 | Baerlocher | G07F 17/3244 273/143 R |
| 7,192,347 | B1 * | 3/2007 | Marks | G07F 17/3262 463/16 |
| 2003/0073480 | A1 * | 4/2003 | Thomas | G07F 17/32 463/18 |
| 2003/0162585 | A1 * | 8/2003 | Bigelow, Jr. | G07F 17/32 463/20 |
| 2005/0192081 | A1 * | 9/2005 | Marks | G07F 17/32 463/20 |
| 2006/0052151 | A1 * | 3/2006 | Gomez | G07F 17/3244 463/16 |
| 2007/0060287 | A1 * | 3/2007 | Reddicks | G07F 17/32 463/19 |
| 2008/0176634 | A1 * | 7/2008 | Berman | G07F 17/3244 463/20 |
| 2009/0042638 | A1 * | 2/2009 | Thomas | G07F 17/32 463/20 |
| 2010/0120495 | A1 * | 5/2010 | Frank | G07F 17/3211 463/20 |
| 2010/0216540 | A1 * | 8/2010 | Berman | G07F 17/32 463/20 |

(Continued)

*Primary Examiner* — Milap Shah

(74) *Attorney, Agent, or Firm* — Nathan Calvert, Esq.; JP Cody, Esq.; Russell D. Culbertson, Esq.

(57) ABSTRACT

A slot machine matrix game employs a player selectable hot spot feature in which the player is prompted to select desired locations to become hot spots in the gaming matrix. The player selectable hot spots may be employed in primary game play or bonus rounds. When a designated target symbol lands on a hot spot, the spot is activated. The number of activated hot spots may be used to award a progressive jackpot. The hot spots may also function to increase a prize multiplier.

15 Claims, 12 Drawing Sheets

(56) References Cited

U.S. PATENT DOCUMENTS

| | | | | |
|---|---|---|---|---|
| 2010/0298042 | A1* | 11/2010 | Berman | G07F 17/3244 463/20 |
| 2011/0218036 | A1* | 9/2011 | Payne | A63F 9/24 463/27 |
| 2015/0170477 | A1* | 6/2015 | Souza | G07F 17/34 463/20 |

* cited by examiner

GAMING MACHINE AND METHOD FOR PROVIDING PLAYER-SELECTABLE ENHANCEMENT SPOTS

TECHNICAL FIELD OF THE INVENTION

The invention relates to gaming machines and methods for conducting reel or symbol array type wagering games including a player selectable hot spot feature.

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office records, but otherwise reserves all rights of copyright whatsoever.

BACKGROUND OF THE INVENTION

Various slot machine games use features that enhance certain game symbols to improve the game experience for games with reels, simulated reels, or other arrays of gaming symbols. For example, many slot machines have features that turn certain symbols wild in certain situations in order to achieve more winning patterns along defined paylines. Other games provide various enhancements to symbol locations in a spin result that provide for higher prizes when the result is evaluated.

What is needed are more exciting variations for the creation and use of symbol enhancements in order to increase player excitement and enjoyment of slot machine games.

SUMMARY OF THE INVENTION

Methods and gaming machines embodying the principles of the present invention provide highly entertaining gaming features for players. The entertainment value is achieved with a slot machine-type gaming system employing a player selectable hot spot feature in which the player is prompted to select desired locations to become hot spots in the matrix of symbol locations. The player selectable hot spots may be employed in base game play or bonus rounds, but this is not limiting and the feature may be used in any suitable game. When a designated target symbol lands on a hot spot, the spot is activated. The number of activated hot spots may be used to award a progressive jackpot. The activated hotspots also may function to increase a prize multiplier. One implementation of the present invention provides a method for operating a wagering game. In some forms, the method includes receiving play initiation inputs through a player input system of a gaming machine while the gaming machine is in a primary game state of a wagering game, and, in response to the play initiation input, providing a base game result which may include a trigger. In response to a trigger in the result, the method causes the system to initiate a secondary game state. In this secondary game state the player is prompted to mark a plurality of locations on the matrix of symbol locations used to show results in the game. The method may also include initiating a prize multiplier for the secondary game state, and providing a possibility of one or more designated target symbols for activating individual marked symbol locations. This possibility of one or more designated target symbols may include modifying the set of game symbols available for a play in the secondary game state to include one or more target symbols. The symbols shown in the matrix of symbol locations may then be randomized to produce a secondary result. In response to a target symbol present on any of the player-marked locations, the method may include increasing the prize multiplier and placing that player-marked location in an activated state if not previously placed in such a state in a previous secondary result. The secondary result is then evaluated for winning patterns and a prize is provided based on any winning patterns found and based on the prize multiplier. The randomization to provide a secondary result may be repeated for a plurality of secondary rounds. Once the number of secondary rounds is completed the method includes evaluating the number of marked locations which have been "activated," that is, placed in the activated state. The number of marked locations which have been activated may be employed to determine if an additional prize (which may be a progressive prize) has been won, and if so, the method includes awarding that additional prize.

The method may include, if a progressive award is won, selecting a progressive prize level from a plurality of progressive prize levels based on the number of activated marked locations. Also, in versions where the matrix of symbol locations in the secondary game state includes a plurality of reels or simulated reels, the method may further include, when prompting the player to mark a plurality of locations, requiring the hot spot locations be on separate reels. In some versions, each secondary round requires a separate wager from the player. In other versions, the secondary game state is a free spin bonus round.

The invention also encompasses a computer program stored on a non-transitory readable medium. The software version is, of course, typically designed to be executed by a gaming machine or networked gaming system. The software includes multiple portions of computer executable code referred to as program code. Gaming results are provided in response to a wager and displayed by display program code that generates simulated slot reels each including one or more symbol locations. The program also has game controller program code for determining game play results involving spins or other randomization of an array of symbols, each spin producing a spin result.

The invention further encompasses a gaming system that includes one or more gaming servers, and a group of electronic gaming machines connected to the servers by a network. The various functionality described herein may be distributed between the electronic gaming machines and the gaming servers in any practically functional way. For example, a Class III architecture may be used in which random number generation and game logic are primarily executed by processors in the electronic gaming machine. Another example architecture is for the servers to determine all aspects of game logic, random number generation, and prize awards. The gaming machines provide functionality of interfacing with the player and animating the game results received from the server in an entertaining manner. However, other embodiments might use a thin client architecture in which the animation is also conducted by the server, and electronic gaming machines serve merely as a terminal to receive button or touch screen input from the player and to display graphics received from the server.

Different features may be included in different versions of the invention. For example, different animation themes may be applied that display the application of the player selectable hot spots in different ways.

These and other advantages and features of the invention will be apparent from the following description of example embodiments, considered along with the accompanying drawings.

DETAILED DESCRIPTION OF EXAMPLE EMBODIMENTS

Figure 9:
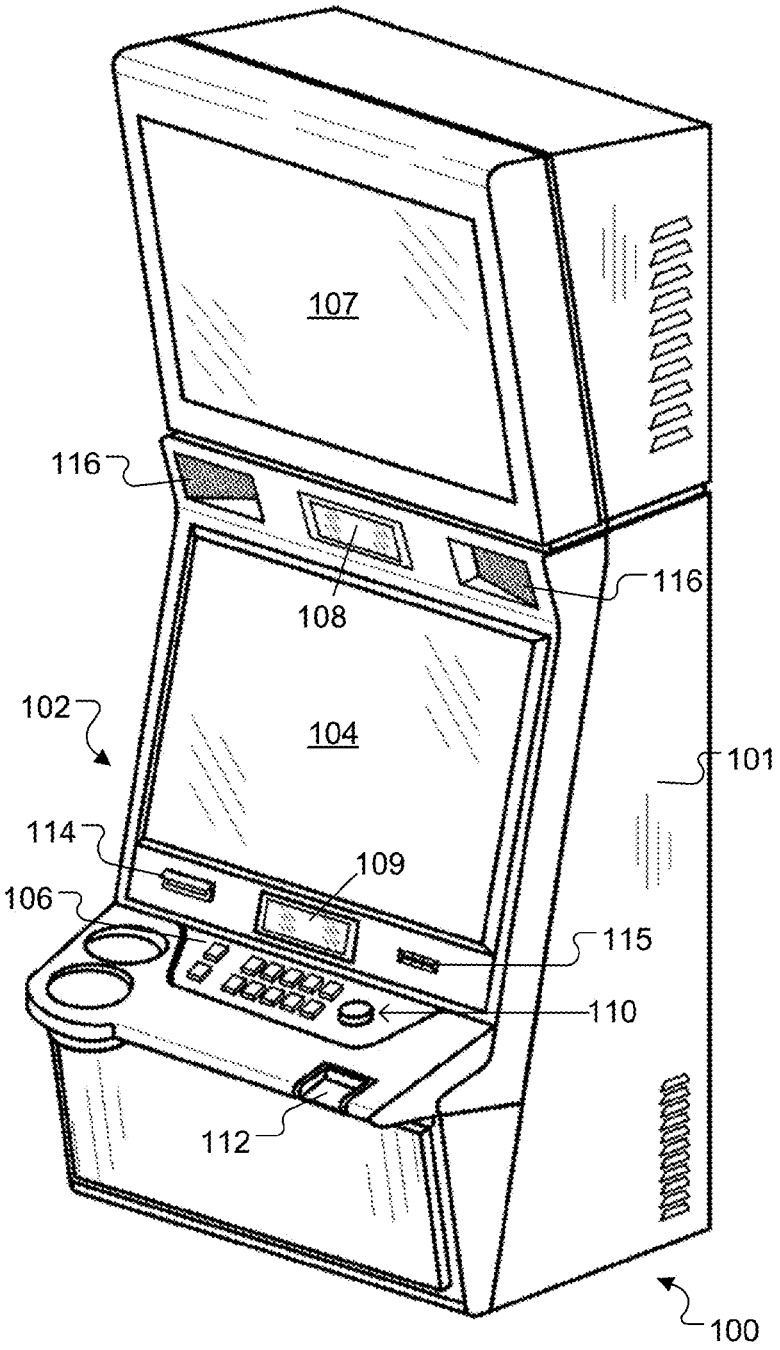
FIG. 9 is a front perspective view of a gaming machine which may be used in a gaming system embodying the principles of the present invention.

FIGS. 1-5 are a sequence of game screen diagrams showing a player selectable hot spot feature according to one embodiment, which would be displayed, for example, on the main display 104 of gaming 100 in FIG. 9. In this embodiment, shown in FIGS. 2-5, the gaming machine's main graphic display includes a matrix of symbol locations 1001 ("matrix", "array") that displays symbols in four symbol locations 1004 on each of five separate columns 1002 or simulated reels. The array 1001 may function as a number of simulated multisymbol reels, simulated unisymbol reels, or individual randomized locations that are updated according to a suitable randomization scheme to achieve the desired variability. Preferably, all the symbol locations 1004 in the array 1001 are updated in response to player wager and game activation input to display a new set of symbols in the array.

In this embodiment of the invention, a slot machine matrix game employs a player selectable hot spot feature in which the player is prompted to select desired symbol locations from a plurality of prompted locations 1005 (FIG. 2) to be hot spots. The player selectable hot spots may be employed in base game play or bonus rounds, but this is not limiting and the feature may be used in any suitable game. The activation and function of the player selectable hot spot feature is further described below, but generally it proceeds according the example sequence of FIGS. 2-5 showing the player selecting a plurality of hot spots 1006 (first appearing in FIG. 3) which may then be activated in the course of the game to increase the prize multiplier 1007.

A group of accounting indicators at the lower edge displays various pieces of data such as the current wager box 1010, available credits 1012, and/or payouts 1014. A message line 1018 displays messages concerning game progress, results, and related information.

While a 4×5 two-dimensional symbol array is shown in FIGS. 2-5, the techniques herein may be employed with any suitable slot machine games that use randomized groups of symbols as the basis of the games. In one alternative version, for example, the matrix of symbol locations includes X (horizontal), Y (vertical), and Z (depth) dimensions with at least two symbol locations deep in the Z dimension. 3D graphics are employed to display the depth of the matrix.

Figure 7:
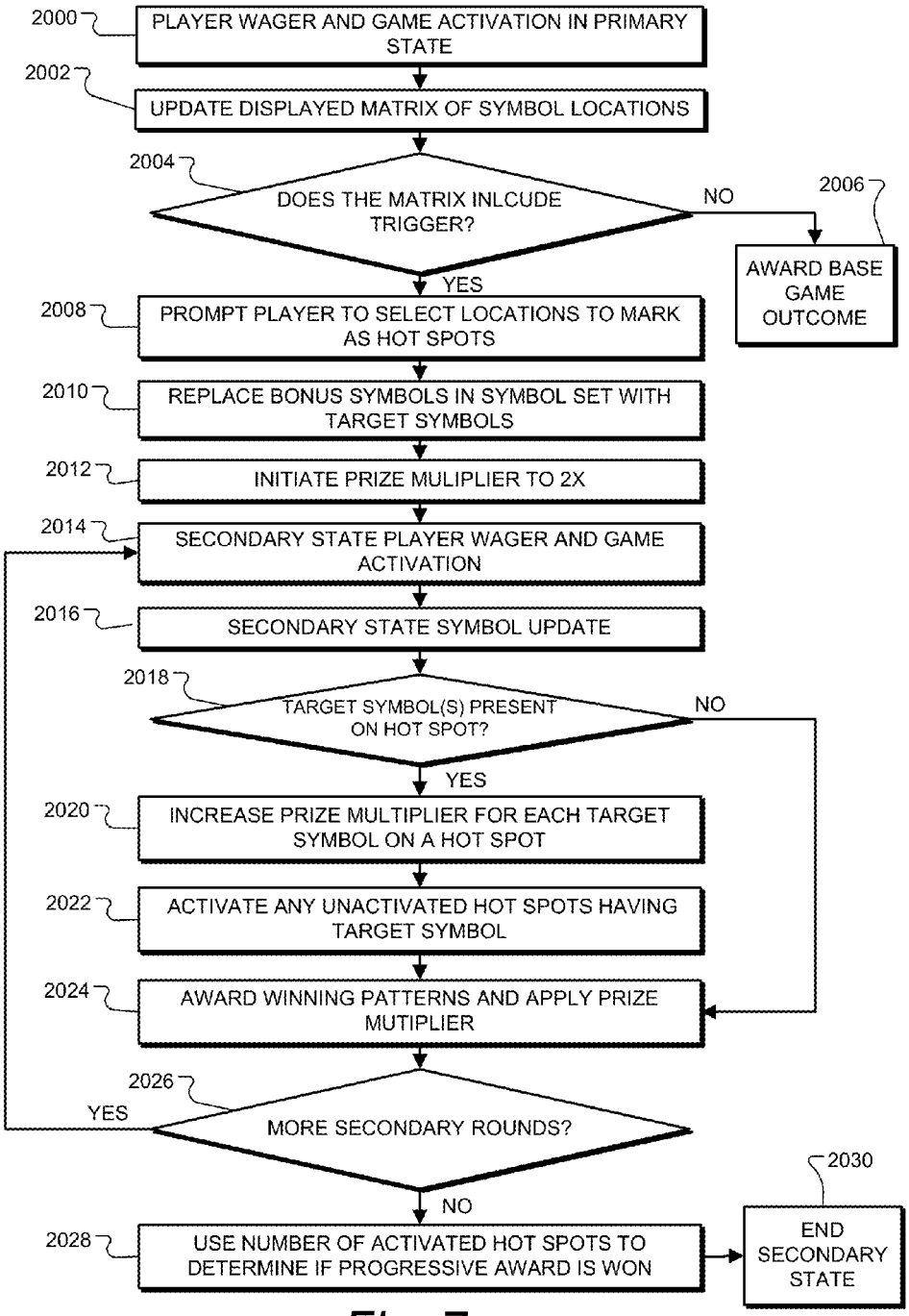
FIG. 7 is a flow chart showing the general method of play for an example embodiment including player selectable hot spots.

FIG. 7 is a flow chart showing the general method of play for an example embodiment including player selectable hot spots. The depicted method preferably takes place in the context of a bonus game, but may also be employed as a secondary state initiated from the primary state of a base game. The embodiment of FIG. 8 includes a bonus round of multiple free spins. In such a case, the wager part of the secondary activation portion of block 2014 (FIG. 7) is skipped for the free spins, and a base game round with a free spin trigger will precede the bonus round.

Referring to FIG. 7, the depicted method begins at block 2000 with displaying an initial array in a primary state associated with a base game having no hot spots activated, the base game array typically including some arrangement of symbols in the symbol locations of the array and a first designated set of symbols available to be shown in an update. To begin a game play, the method receives a wager from the game player at block 2000, which typically includes of some input from the player to set the amount to be wagered from their credit amount on the machine. This block may also be carried over from previous game rounds by simply starting the game with the previous wager amount set. Then, the method receives a play input from the player. This typically happens through a 'Play' button on the game cabinet or touchscreen display, and serves to place the wager and start a single round of game play in the base game. The method typically conducts the activated game at block 2002 by showing the matrix of symbols being updated or scrambled in some manner, with new symbols appearing in the symbol locations according to random selection or a randomly-selected game outcome. In embodiments having reels, reels displays, or simulated reels, this is conducted by spinning the reels, and then allowing them to come to a stop to show the various updated symbols in the symbol locations.

Figure 1:
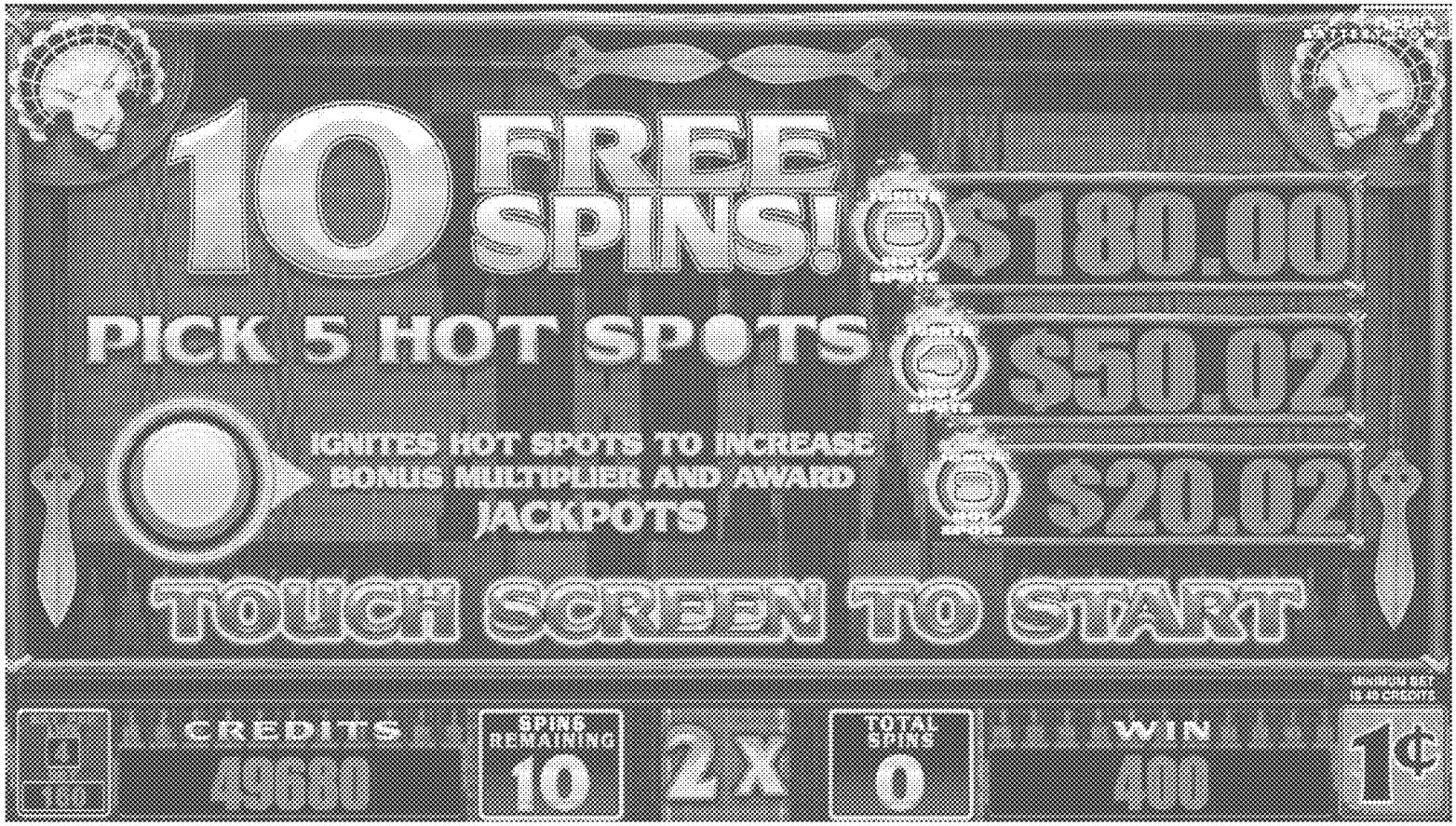
FIGS. 1-5 are a sequence of game screen diagrams showing a player selectable hot spot feature according to one embodiment.
Figure 2:
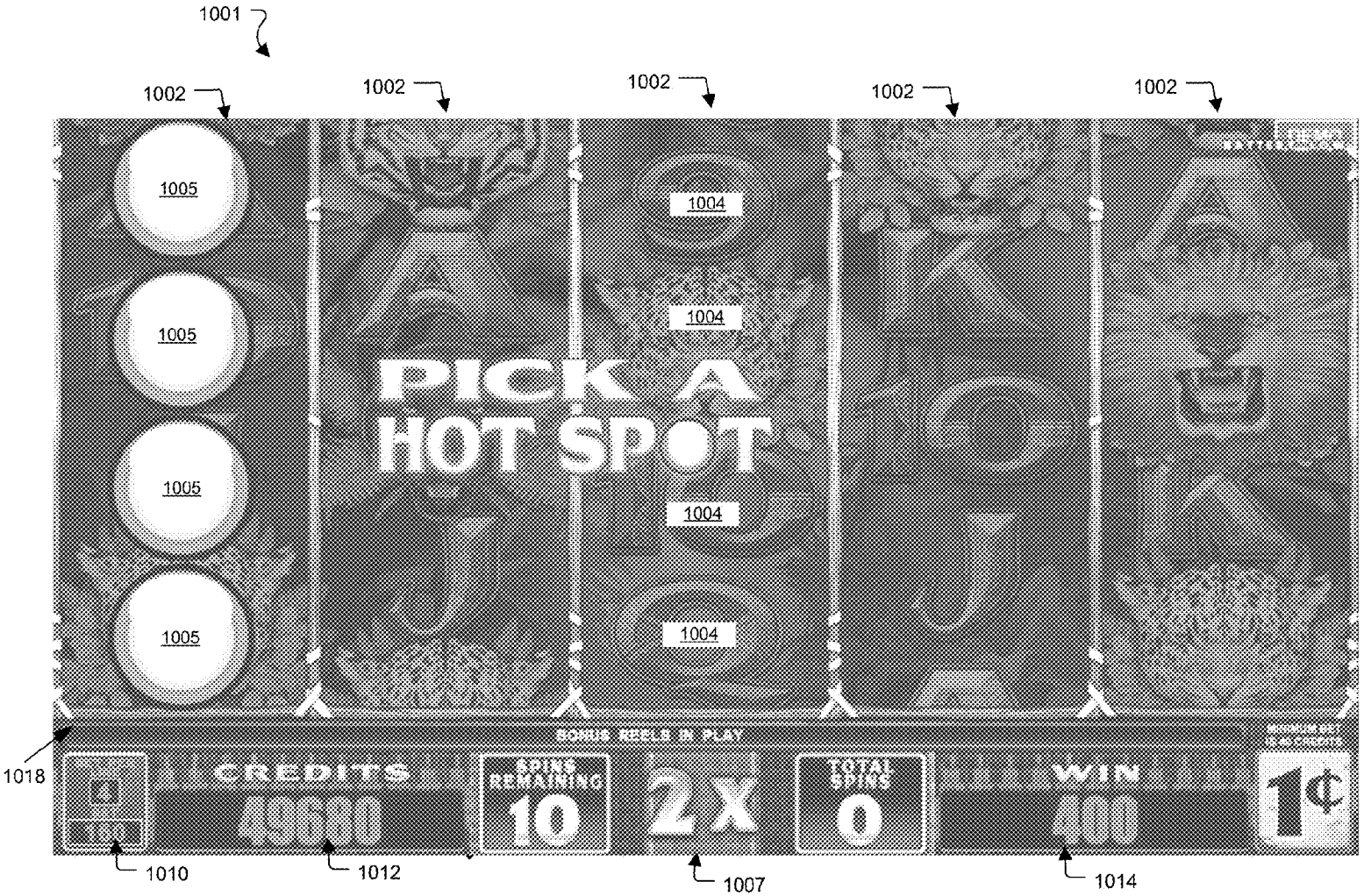
Figure 3:
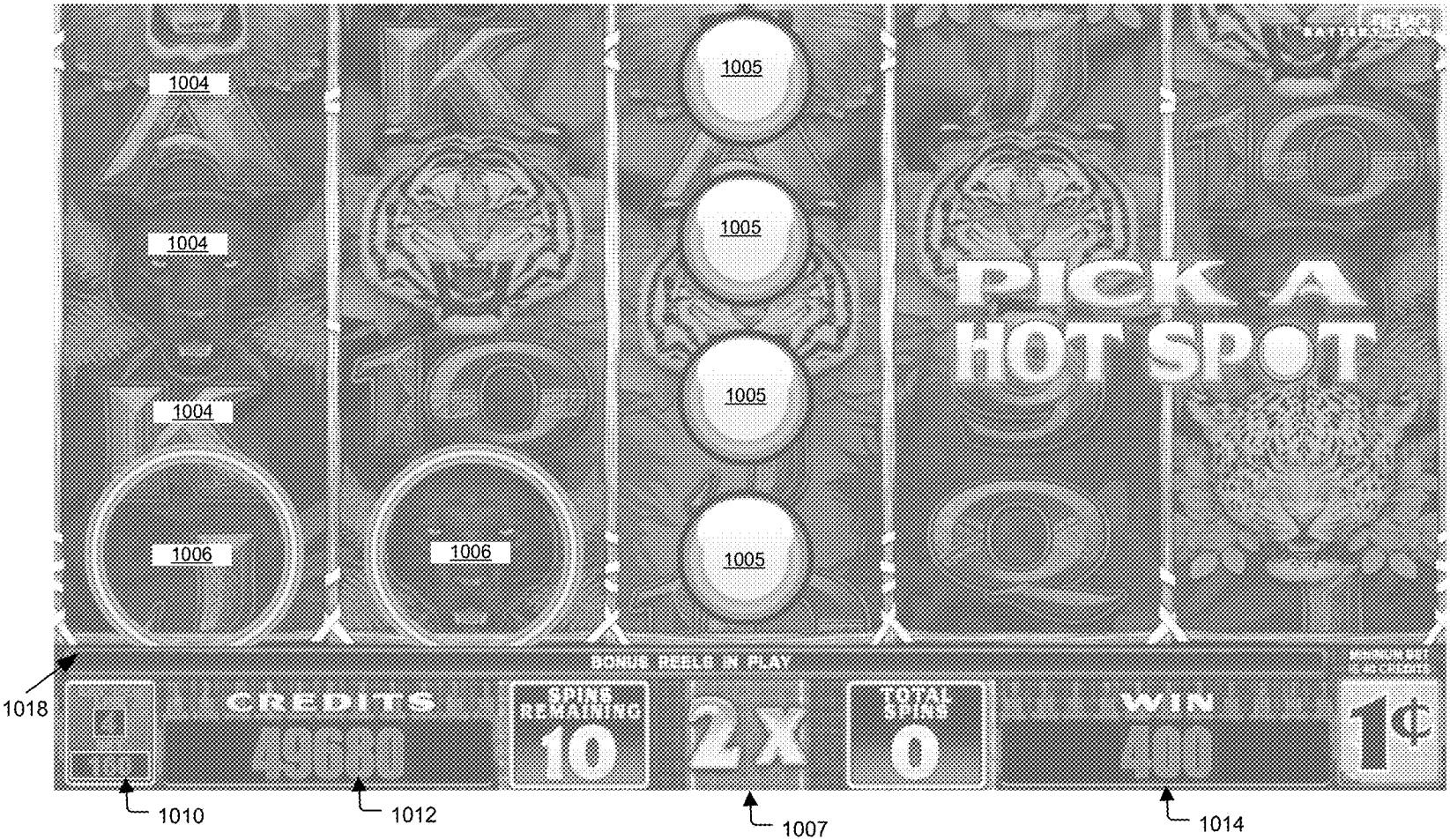
Figure 4:
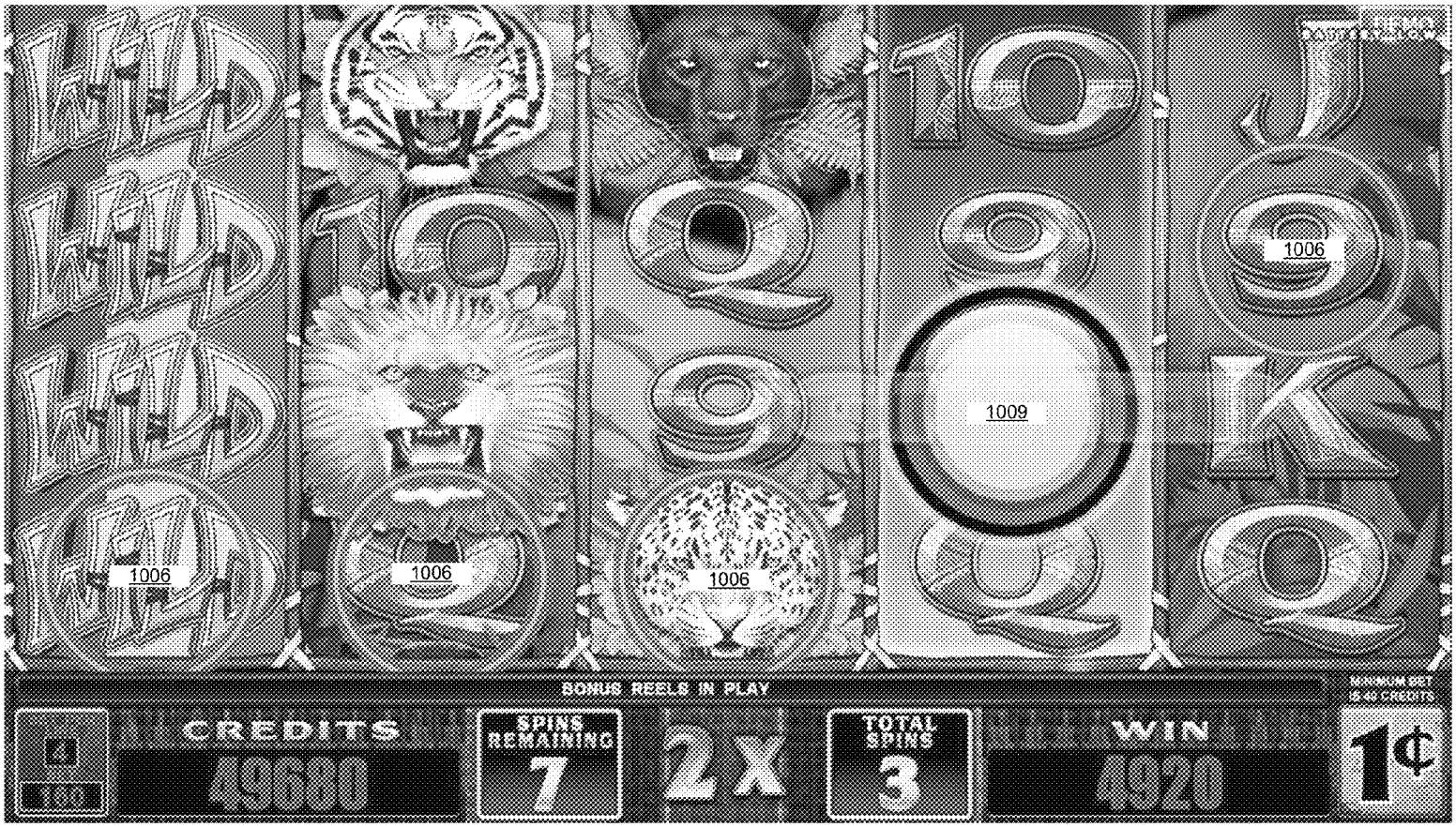
Figure 5:
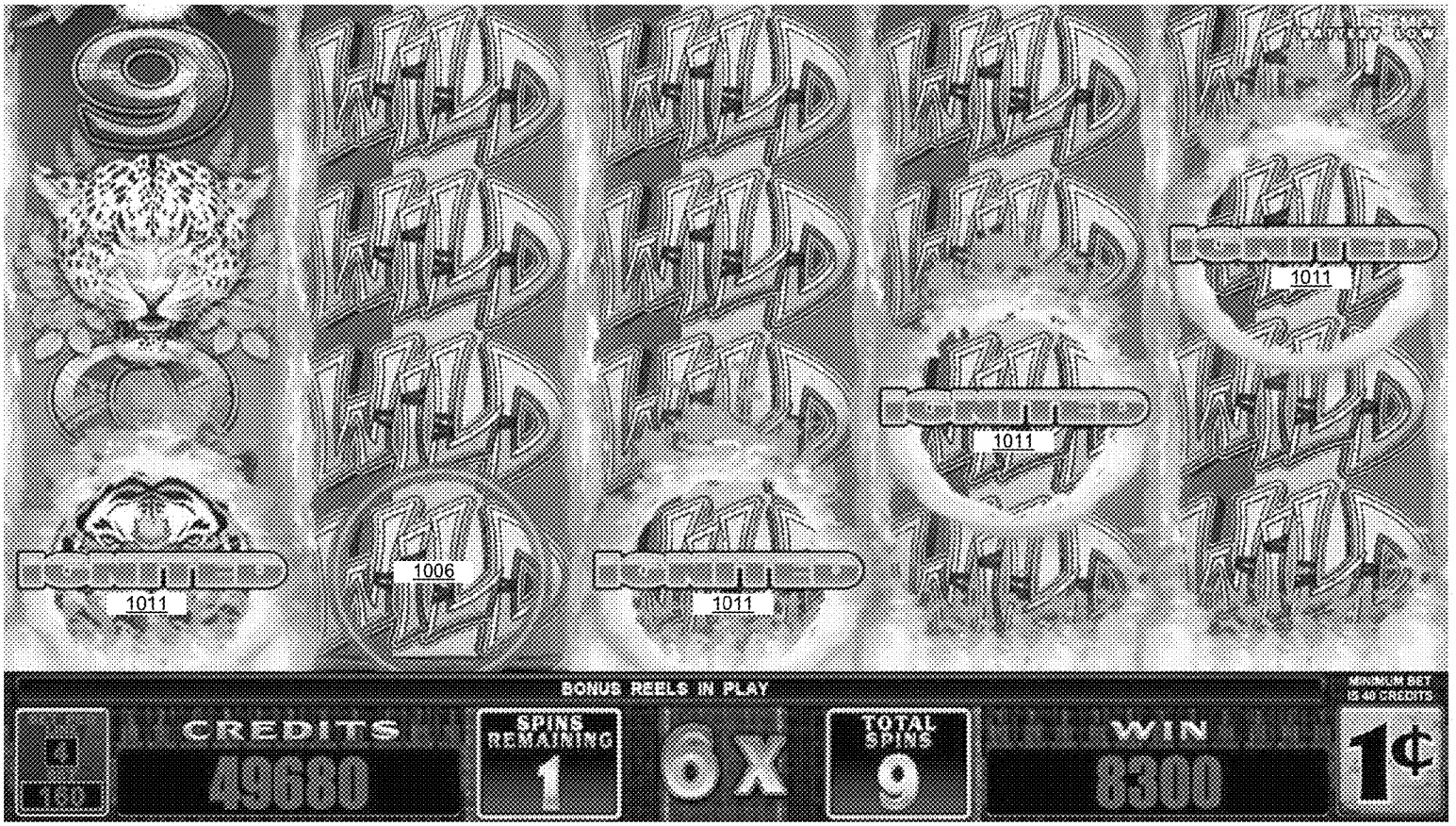

In this embodiment, the player selectable hot spot feature is available in response to a qualifying event such as a trigger pattern or a mystery trigger in the game result, as shown by block 2004 in which the process checks whether the updated matrix or "spin" currently triggers the secondary game state. If not, the game round is completed according to the other games rules and bonus features at block 2006, with the array being evaluated and any indicated prizes awarded. If the spin includes a secondary state trigger at block 2004, the spin qualifies to activate a player selectable hot spot feature as shown in the process blocks 2008-2030. The secondary state begins with a prompt to the player to select desired locations to mark as hot spots, an example of which process is depicted in FIGS. 1-3. The example screen of FIG. 1 shows the start of the secondary state, the screen showing the game rules in the secondary state to the player. In this version, the player is prompted to select a symbol location 1004 from a plurality of prompted symbol locations 1005 available for selection, as shown in FIG. 2. After a player makes a selection for a desired hot spot, by touching the location 1005 on a touchscreen or otherwise selecting it by the player controls, the location becomes a selected hot spot 1006 and is marked as indicated by locations 1006 in FIG. 3. The designated markings, in this example a circle, stay with the selected location for the course of the secondary state of game play. In this version, the available locations 1005 for each player selection are all the locations 1004 of an individual simulated reel, the array column 1002 (the columns being referenced in FIG. 2). However, this is not limiting and more or less choices may be provided for each player selection rather than one location 1004 per reel as in the illustrated example. In some versions, all locations 1004 on the matrix may be available for each player selection. The prompting and selection process of block 2008, exemplified in FIGS. 2 and 3, continues until the player has selected all allowed hot spots. In this depicted version five hot spots are provided, but other versions may provide other numbers of selectable hot spots, and may vary the number of hot spots allowed to be selected based on game conditions, such as various trigger patterns.

Next at block 2010, the process to initialize the second game state may update the available set of symbols that can be shown on the matrix. This may involve replacing certain bonus symbols from the symbol set used in the primary game state with target symbols, which are employed in the secondary game state to activate the hot spots. While this version updates the available symbol set, other versions may simply repurpose existing symbols from the primary game state to function as target symbols for hot spot activation.

Next at block 2012, the process initiates a prize multiplier to be used in the secondary game state. As depicted in the example of FIG. 2, the multiplier 1007 is initiated to 2×, but it may be initiated to 1× or another multiple value. The multiplier value may be initiated to different values depending on conditions in the primary game state, such as the trigger or wager amount. Preferably, the multiple 1007 is both modified and applied by game play during the secondary game state, as further described below.

At block 2014, the process receives a player wager and game activation for the secondary game state. Note that some versions may not include a wager at this step, and some versions may conduct the activation, typically a simulated reel spin, automatically, while some may include a manual activation. In response to the activation, the process at block 2016 updates the symbol array to display new symbols based on the set of symbols provided as available at block 2010. This block preferably conducts a randomization or randomly selects an outcome to display, and displays the update as a reel spin or other randomized update of the matrix of symbol locations. After the update, the process checks to see if any target symbols are present on a hot spot as indicated at block 2018, and if so, the process at block 2020 increases the prize multiplier, preferably incrementing by 1× for each target symbol on a hot spot. In some versions, certain designated conditions in the second state may decrease the multiplier. For example, a designated negative symbol landing on a hot spot, or the condition of not having a target symbol on a hot spot for a designated number of game rounds. If a target symbol lands on a hot spot that has not previously been activated in the secondary game state, the situation depicted in FIG. 4 by target symbol 1009 landing on a hot spot, that hot spot is activated at block 2022, and preferably graphically modified to show it is activated. In this version, the activation is shown by a ring of fire animated on the hot spot, and the word "ignited" shown over the spot, as depicted by the four activated hot spots 1011 shown in FIG. 5. Once activated (depicted in the screenshots as "ignited"), the hot spots preferably remain activated until the secondary game state is exited, however some versions may selectively remove the activated state from certain hot spots before then. Next at block 2024, the process awards any prize-winning patterns produced by the update of 2016, preferably applying the modified prize multiplier from block 2020. If, at block 2026, more secondary game rounds are available, the process then returns to block 2014 to begin the next secondary game round. The number of secondary game rounds may be fixed or variable depending on certain conditions. In one version, the hot spot feature is provided as an enhancement to the base game, and provided as a fixed-length feature for a number of base game rounds, these base game rounds being conducted with the base game in the secondary state. As another example, the embodiment of FIG. 8 uses a fixed number of secondary game rounds that are each a bonus game "free spin" with no additional wager required. Other versions may provide a fixed number of secondary state game rounds, or may provide a number that can be increased by certain trigger outcomes. Other versions may provide a secondary game state that continues until a minimum prize level is achieved, for example a predetermined amount designated to be won by a randomly selected game outcome may be implemented as a secondary game state that continues until such predetermined amount is won. In some versions, randomly awarded game outcomes may be "reverse-mapped" to a series of secondary state rounds, and the rounds ended when the award designated by the game outcome is completed. However, other implementations of the invention use "true spin" game logic in which randomly updated symbols determine the game outcome at each update.

Figure 6:
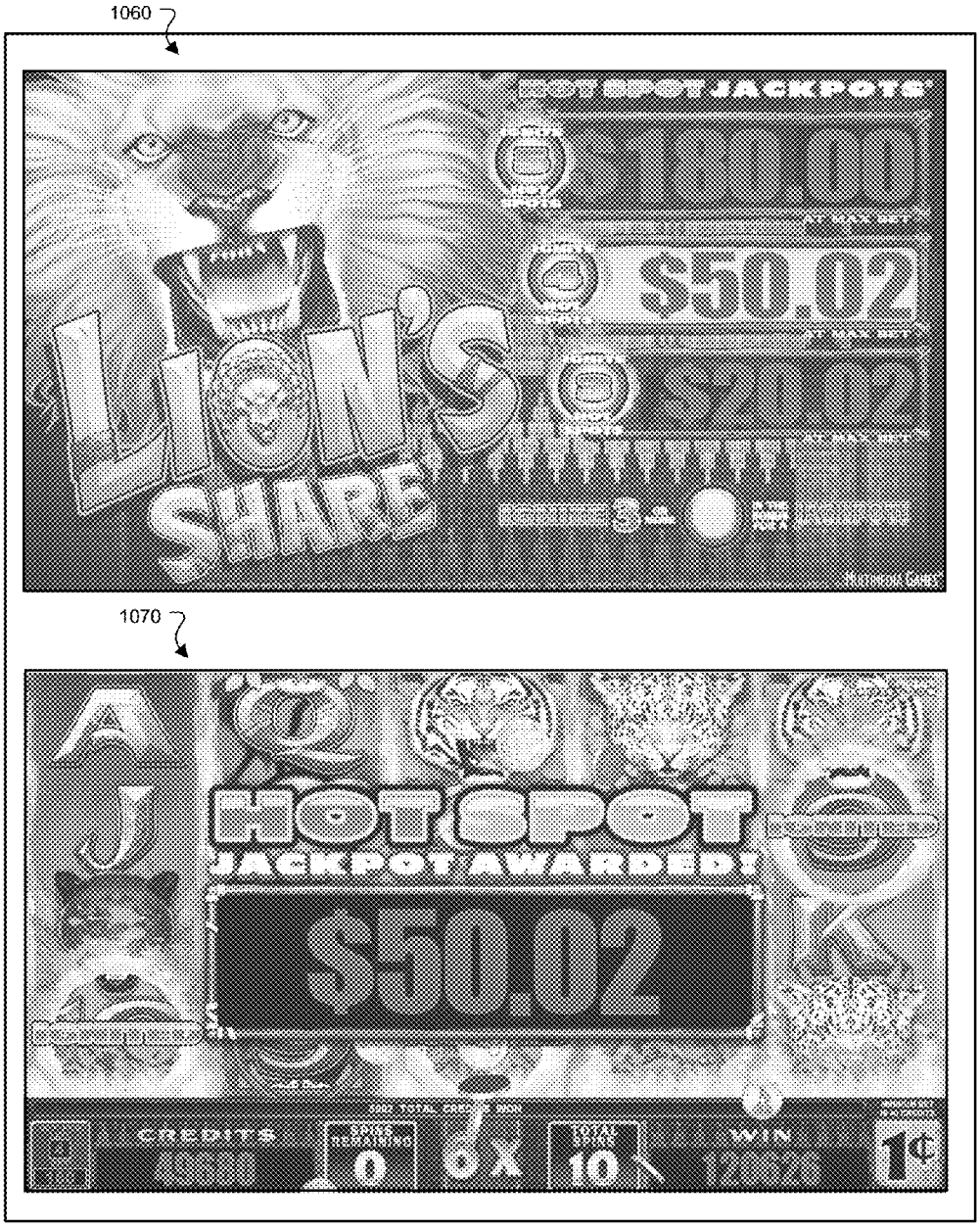
FIG. 6 shows top and bottom displays of a progressive award resulting from the hot spot feature according to one embodiment.

If no more secondary game rounds are available at block 2026, the process goes to block 2028, where it checks the number of activated hot spots in the secondary state to determine if a progressive award is won. Block 2028 will award any progressive prize achieved by the number of activated hot spots, for example the progressive award shown awarded in the example top and bottom game screens 1060 and 1070 of FIG. 6, such as would be displayed on top and bottom displays 107 and 104 of gaming machine 100. In the depicted version, activating three or more hot spots wins a progressive prize, with smaller, lower tier prizes given for three or four activations, and the largest prize given for five activations. While in this version a progressive award is shown, other types of bonus awards may be used. Next at block 2030, the process ends the secondary state and returns the game back to the primary state, which is preferably normal base game play.

Figure 8:
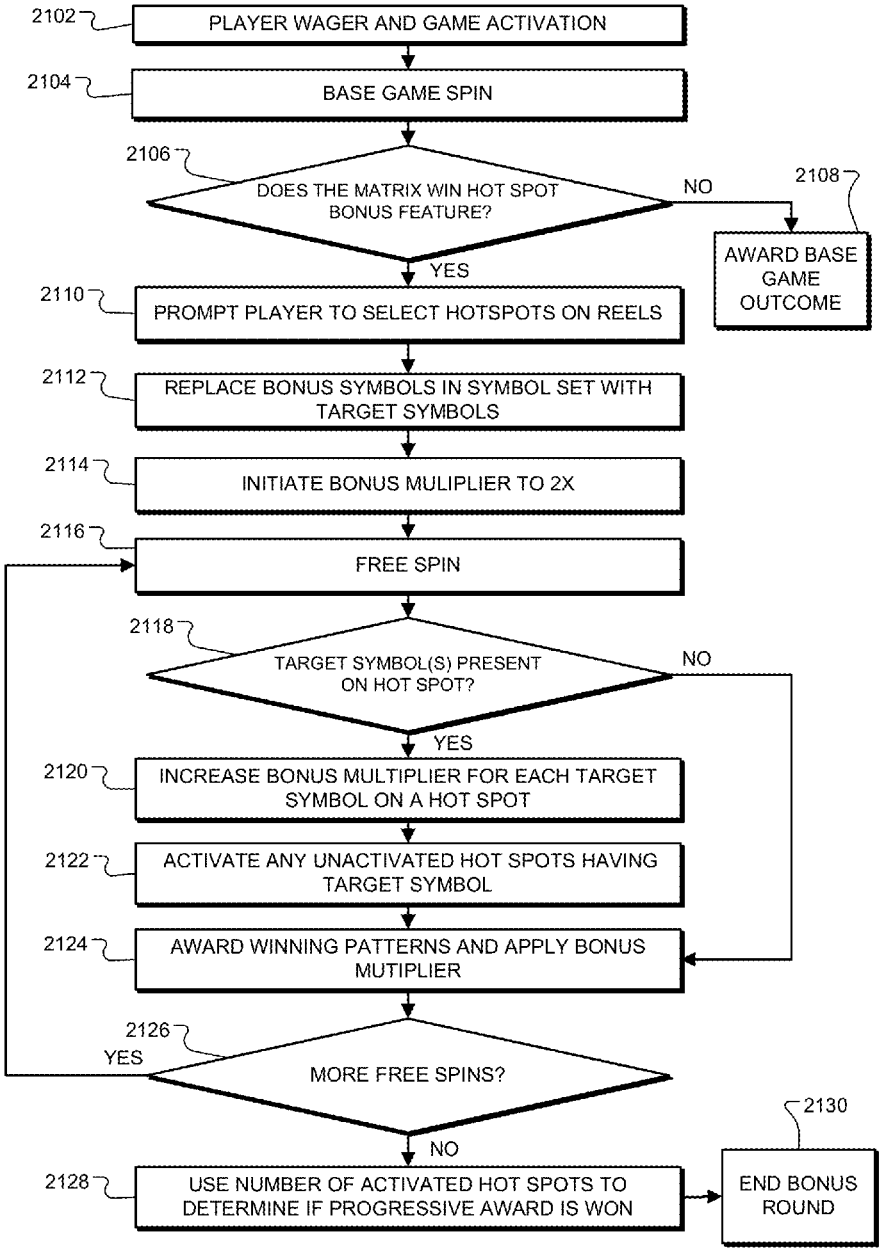
FIG. 8 is a flow chart showing a game method using a player selectable hot spots feature according to another embodiment.

FIG. 8 shows a flowchart of gaming process according to another embodiment, in which the player selectable hot spot feature is employed in a free spin bonus round. This embodiment includes a free spin bonus round triggered by three or more scatter bonus symbols. If a base-game spin triggers the bonus at block 2106, then the player selectable hot spot feature event is entered at block 2110. If no free spin bonus is triggered, the process goes to block 2108 and evaluates and base game outcome. It is noted that while this embodiment provides the player selectable hot spot feature in response to a trigger pattern, the trigger mechanism may be a mystery trigger (i.e., an arrangement in which no trigger event is apparent to the player), or a special symbol, pattern, or scatter pattern. The trigger may also be possible only on a certain minimum wager level that makes the feature available in the base game. To initialize the bonus game, at blocks 2112 and 2114 the symbol set is updated and a bonus multiplier initiated as described with respect to blocks 2010 and 2012 of FIG. 7. Next, the selectable hot spot feature is conducted according to the process in FIG. 7, but with free spins instead of the wager and activation of the base game round. As shown, each round of the bonus free spin game begins with a free spin conducted at block 2116. In this version, the length of the free spin bonus round is determined and shown to the player on the "spins remaining" indicator as depicted in the above FIGS. 3-5.

Figure 12:
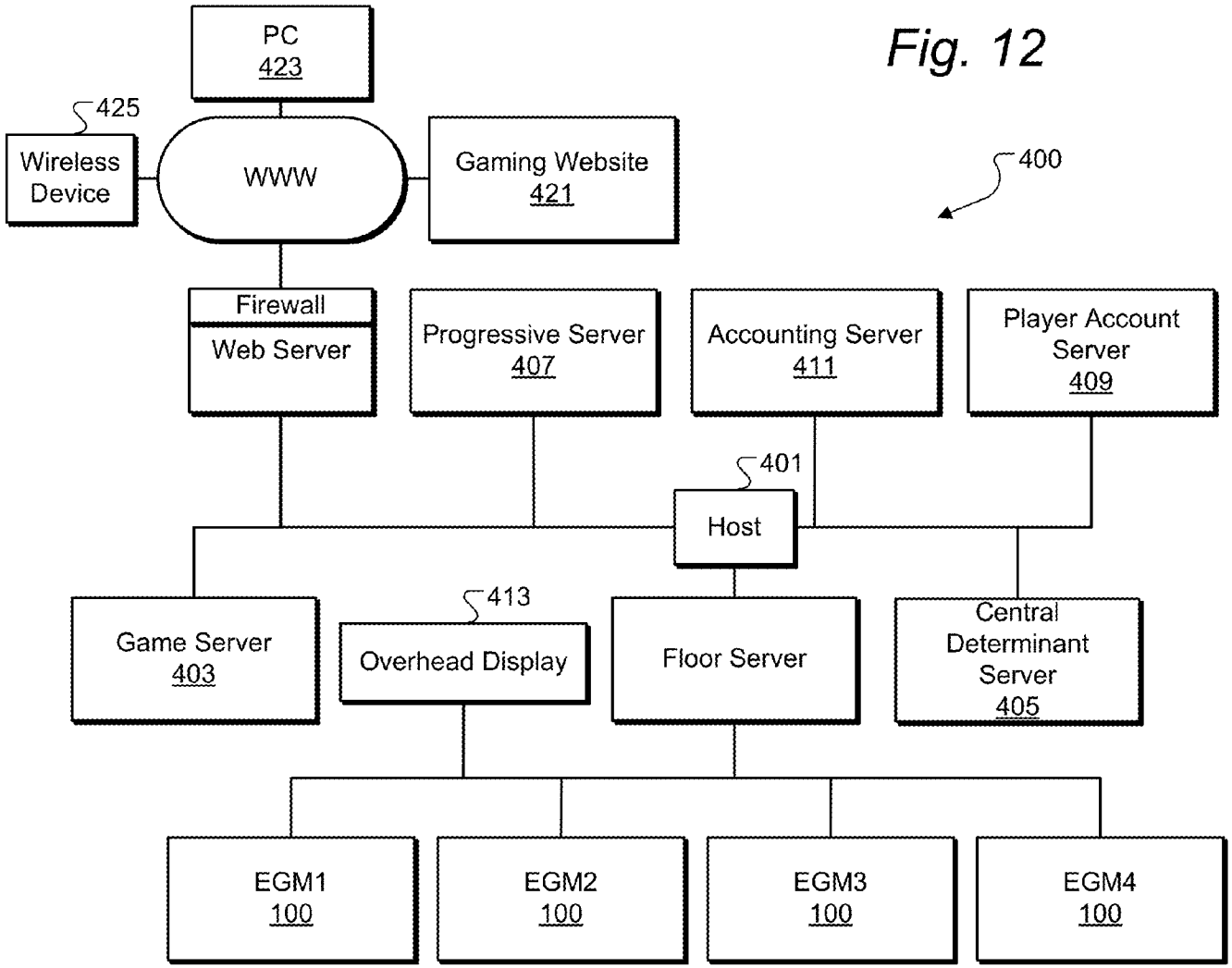
FIG. 12 is a system block diagram of a gaming system according to another embodiment.

In a preferred version, the above described game is provided on a gaming network such as that of FIG. 12. Preferably a Class III architecture is employed with random number generation and game functionality implemented on the EGM. It should be understood that this is only one example embodiment, and other versions may divide the processing tasks of the game method in a different manner. For example, some systems may employ a thin or zero client architecture in which practically all of the processing tasks are performed at the game server, and only display information for the player interface transmitted to the electronic gaming machine. In such an embodiment, only the steps involving player input or display are performed by the electronic gaming machine, with the remaining steps performed by one of the game servers in the system. In such a case, though, the software architecture is preferably designed as a thin client or zero client in which a dedicated virtual machine running on the game server (or a virtual machine server connected in the gaming network) performs the tasks designated in the present drawing as occurring "at the gaming machine." In the depicted method, the various method steps are performed by the respective computer hardware operating under control of computer program code. While central processor arrangements may vary (for example award controllers may be integrated on the same machine with a gaming server, or may be a separate server connected on a secure network), the particular central determinant architecture is not limiting and will be referred to generally in this drawing as the game server (i.e. 302, 403). As shown at block 2000 in FIG. 7, the method performed at the game server further includes receiving game play requests originating from electronic gaming machine 100 (FIG. 9), and sending commands to the gaming machine to show reels spinning, player selectable hot spots appearing, and results being displayed. The division of game logic steps between gaming machines and servers is known in the art and may be accomplished according to suitable methods allowed or required by law in the various gaming jurisdictions.

Figure 10:
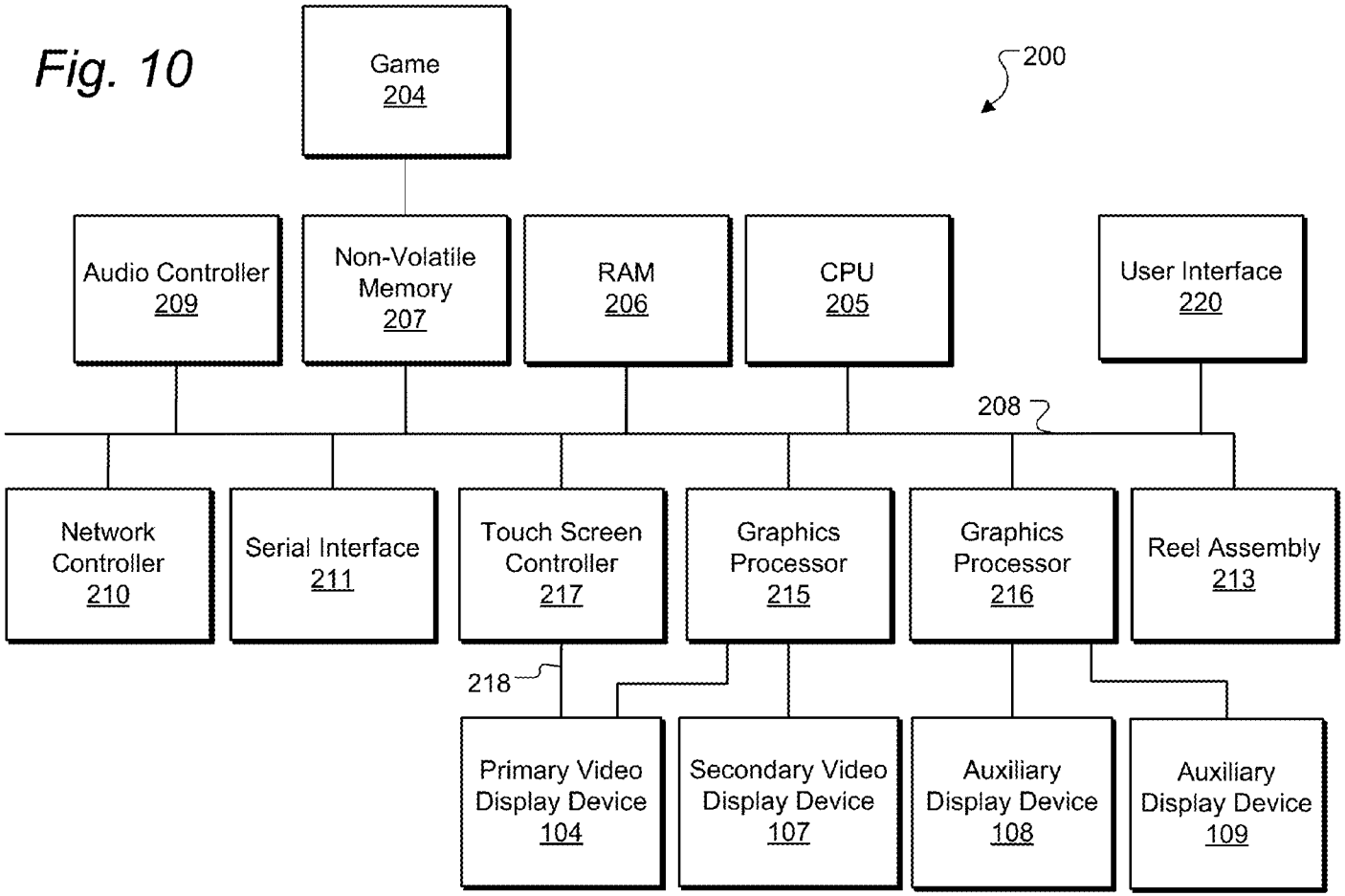
FIG. 10 is a block diagram showing various electronic components of the gaming machine shown in FIG. 9 together with additional gaming system components.

FIG. 9 shows a gaming machine 100 that may be used to implement a player selectable hot spot feature according to the present invention. The block diagram of FIG. 10 shows further details of gaming machine 100. Referring to FIG. 9, gaming machine 100 includes a cabinet 101 having a front side generally shown at reference numeral 102. A primary video display device 104 is mounted in a central portion of the front surface 102, with a ledge 106 positioned below the primary video display device and projecting forwardly from the plane of the primary video display device. In addition to primary video display device 104, the illustrated gaming machine 100 includes a secondary video display device 107 positioned above the primary video display device. Gaming machine 100 also includes two additional smaller auxiliary display devices, an upper auxiliary display device 108 and a lower auxiliary display device 109. It should also be noted that each display device referenced herein may include any suitable display device including a cathode ray tube, liquid crystal display, plasma display, LED display, or any other type of display device currently known or that may be developed in the future.

The illustrated gaming machine 100 shown in FIG. 9 also includes a number of mechanical control buttons 110 mounted on ledge 106. These control buttons 110 may allow a player to select a bet level, select pay lines, select a type of game or game feature, and actually start a play in a primary game. Other forms of gaming machines according to the invention may include switches, joysticks, or other mechanical input devices, and/or virtual buttons and other controls implemented on a suitable touch screen video display. For example, primary video display device 104 in gaming machine 100 provides a convenient display device for implementing touch screen controls. Touch screen controls may also be included on the video display device on ledge 106 in addition to or in lieu of some or all of the mechanical buttons 110.

It will be appreciated that gaming machines may also include a number of other player interface devices in addition to devices that are considered player controls for use in playing a particular game. Gaming machine 100 also includes a currency/voucher acceptor having an input ramp 112, a player card reader having a player card input 114, and a voucher/receipt printer having a voucher/receipt output 115. Audio speakers 116 generate an audio output to enhance the user's playing experience. Numerous other types of devices may be included in gaming machines that may be used according to the present invention.

FIG. 10 shows a logical and hardware block diagram 200 of gaming machine 100 which includes a central processing unit (CPU) 205 along with random access memory 206 and nonvolatile memory or storage device 207. All of these devices are connected on a system bus 208 with an audio controller 209, a network controller 210, and a serial interface 211. A graphics processor 215 is also connected on bus 208 and is connected to drive primary video display device 104 and secondary video display device 107 (both mounted on cabinet 101 as shown in FIG. 9). A second graphics processor 216 is also connected on bus 208 in this example to drive the auxiliary display devices 108 and 109 also shown in FIG. 9. As shown in FIG. 10, gaming machine 100 also includes a touch screen controller 217 connected to system bus 208. Touch screen controller 217 is also connected via signal path 218 to receive signals from a touch screen element associated with primary video display device 104. It will be appreciated that the touch screen element itself typically comprises a thin film that is secured over the display surface of primary video display device 104. The touch screen element itself is not illustrated or referenced separately in the figures.

Those familiar with data processing devices and systems will appreciate that other basic electronic components will be included in gaming machine 100 such as a power supply, cooling systems for the various system components, audio amplifiers, and other devices that are common in gaming machines. These additional devices are omitted from the drawings so as not to obscure the present invention in unnecessary detail.

All of the elements 205, 206, 207, 208, 209, 210, and 211 shown in FIG. 10 are elements commonly associated with a personal computer. These elements are preferably mounted on a standard personal computer chassis and housed in a standard personal computer housing which is itself mounted in cabinet 101 shown in FIG. 9. Alternatively, the various electronic components may be mounted on one or more circuit boards housed within cabinet 101 without a separate enclosure such as those found in personal computers. Those familiar with data processing systems and the various data processing elements shown in FIG. 10 will appreciate that many variations on this illustrated structure may be used within the scope of the present invention. For example, since serial communications are commonly employed to communicate with a touch screen controller such as touch screen controller 217, the touch screen controller may not be connected on system bus 208, but instead include a serial communications line to serial interface 211, which may be a USB controller or a IEEE 1394 controller for example. It will also be appreciated that some of the devices shown in FIG. 10 as being connected directly on system bus 208 may in fact communicate with the other system components through a suitable expansion bus. Audio controller 209, for example, may be connected to the system via a PCIe bus. System bus 208 is shown in FIG. 10 merely to indicate that the various components are connected in some fashion for communication with CPU 205 and is not intended to limit the invention to any particular bus architecture. Numerous other variations in the gaming machine internal structure and system may be used without departing from the principles of the present invention.

It will also be appreciated that graphics processors are also commonly a part of modern computer systems. Although separate graphics processor 215 is shown for controlling primary video display device 104, secondary video display device 107, and graphics processor 216 is shown for controlling both auxiliary display devices 108 and 109, it will be appreciated that CPU 205 may control all of the display devices directly without any intermediate graphics processor. The invention is not limited to any particular arrangement of processing devices for controlling the video display devices included with gaming machine 100. Also, a gaming machine implementing the present invention is not limited to any particular number of video display device or other types of display devices.

In the illustrated gaming machine 100, CPU 205 executes software which ultimately controls the entire gaming machine including the receipt of player inputs and the presentation of the graphic symbols displayed according to the invention through the display devices 104, 107, 108, and 109 associated with the gaming machine. As will be discussed further below, CPU 205 either alone or in combination with graphics processor 215 may implement a presentation controller for performing functions associated with a primary game that may be available through the gaming machine and may also implement a game client for directing one or more display devices at the gaming machine to display portions of a player selectable hot spot feature according to the present invention. CPU 205 also executes software related to communications handled through network controller 210, and software related to various peripheral devices such as those connected to the system through audio controller 209, serial interface 211, and touch screen controller 217. CPU 205 may also execute software to perform accounting functions associated with game play. Random access memory 206 provides memory for use by CPU 205 in executing its various software programs while the nonvolatile memory or storage device 207 may comprise a hard drive or other mass storage device providing storage for programs not in use or for other data generated or used in the course of gaming machine operation. Network controller 210 provides an interface to other components of a gaming system in which gaming machine 100 is included. In particular, network controller 210 provides an interface to a game controller which controls certain aspects of the player selectable hot spot feature as will be discussed below in connection with FIGS. 11 and 12.

It should be noted that the invention is not limited to gaming machines employing the personal computer-type arrangement of processing devices and interfaces shown in example gaming machine 100. Other gaming machines through which a player selectable hot spot feature is implemented may include one or more special purpose processing devices to perform the various processing steps for implementing the present invention. Unlike general purpose processing devices such as CPU 205, these special purpose processing devices may not employ operational program code to direct the various processing steps.

It should also be noted that the invention is not limited to gaming machines including only video display devices for conveying results. It is possible to implement a player selectable hot spot feature within the scope of the present invention using an electro mechanical arrangement or even a purely mechanical arrangement for displaying the symbols needed to complete the player selectable hot spot feature as described herein. However, the most preferred forms of the invention utilize one or more video display devices for displaying the spinning reels, the accumulated symbols, and the player selectable hot spots feature. For example, a gaming machine suitable for providing a player selectable hot spot feature may include a mechanical reel-type display rather than a video-type display device for displaying results in a primary game, and include a video display device for presenting the player selectable hot spot feature as a bonus game.

Still referring to the hardware and logical block diagram 200 showing an example design for a gaming machine 100, the depicted machine in operation is controlled generally by CPU 205 which stores operating programs and data in memory 207 with wagering game 204, user interface 220, network controller 210, audio/visual controllers, and reel assembly 213 (if mechanical reel configuration). CPU or game processor 205 may comprise a conventional microprocessor, such as an Intel® Pentium® of Core® microprocessor, mounted on a printed circuit board with supporting ports, drivers, memory, software, and firmware to communicate with and control gaming machine operations, such as through the execution of coding stored in memory 207 including one or more wagering games 204. Game processor 205 connects to user interface 220 such that a player may enter input information and game processor 205 may respond according to its programming, such as to apply a wager and initiate execution of a game.

Game processor 205 also may connect through network controller 210 to a gaming network, such as example casino server network 400 shown in FIG. 12. Referring now to FIG. 12, the casino server network 400 may be implemented over one or more site locations and include host server 401, game server 403 (which may be configured to provide game processor functionality including determining game outcomes and providing audio/visual instructions to a remote gaming device), central determination server 405 (which may be configured to determine lottery, bingo, or other centrally determined game outcomes and provide the information to networked gaming machines 100 providing lottery and bingo-based wagering games to patrons), progressive server 407 (which may be configured to accumulate a progressive pool from a portion of wagering proceeds or operator marketing funds and to award progressive awards upon the occurrence of a progressive award winning event to one or more networked gaming machines 100), player account server 409 (which may be configured to collect and store player information and/or awards and to provide player information to gaming machines 100 after receiving player identification information such as from a player card), and accounting server 411 (which may be configured to receive and store data from networked gaming machines 100 and to use the data to provide reports and analyses to an operator).

Through its network connection, gaming machine 100 may be monitored by an operator through one or more servers such as to assure proper operation, and, data and information may be shared between gaming machine 100 and respective of the servers in the network such as to accumulate or provide player promotional value, to provide server-based games, or to pay server-based awards.

Figure 11:
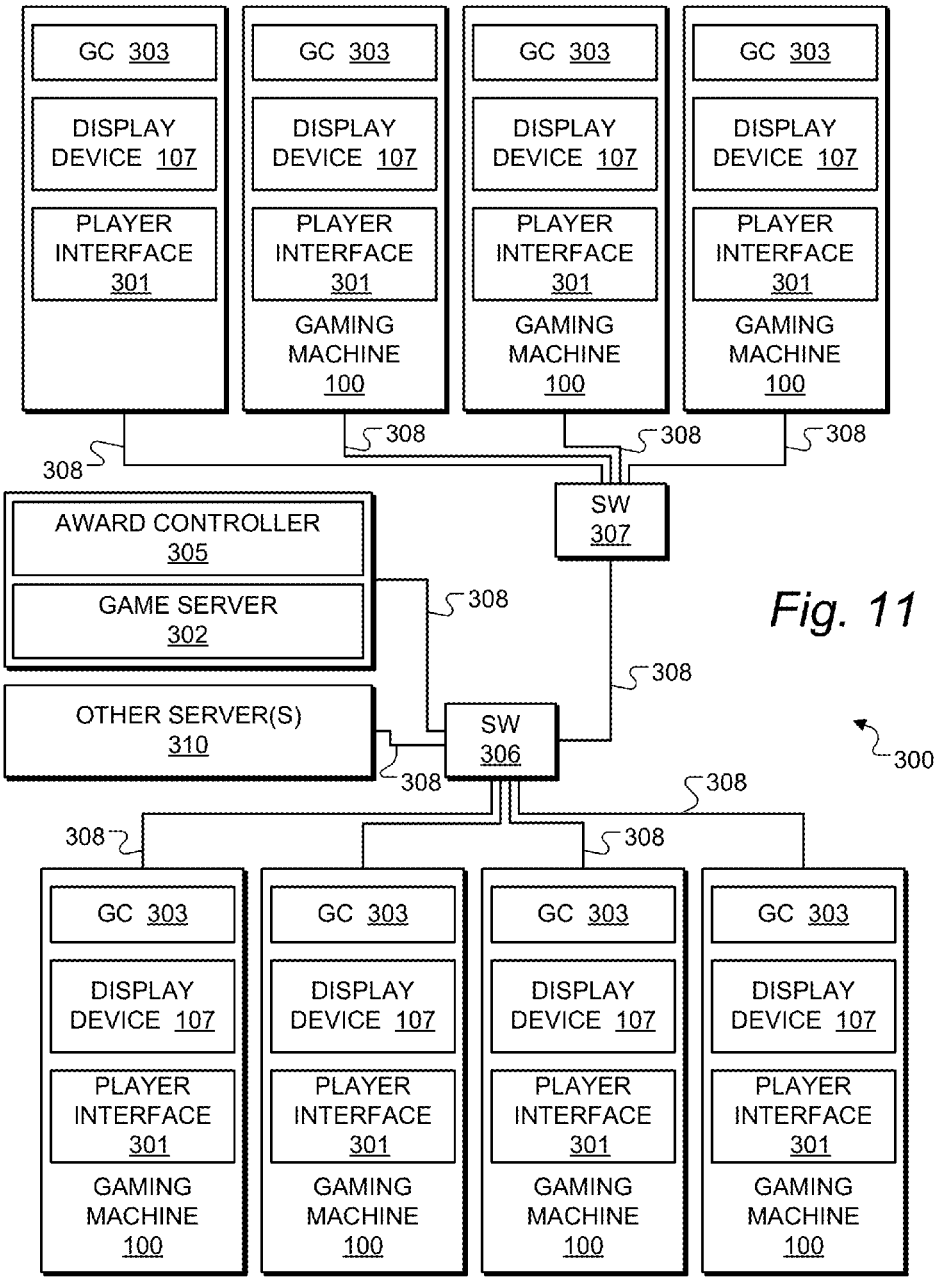
FIG. 11 is a system block diagram of a gaming system according to one embodiment of the present invention.

Referring now to FIG. 11, a gaming system 300 according to another embodiment of the present invention is shown again in a network and system diagram format. System 300 includes a number of gaming machines, each comprising a gaming machine 100 in this example implementation. For purposes of describing system 300, each gaming machine 100 in FIG. 11 is shown as including a video display device 107 and a player interface that may include buttons, switches, or other physical controls and/or touch screen controls as discussed above in connection with FIG. 9. This player interface is labeled 301 in FIG. 11. System 300 further includes a game server 302 and a respective game client 303 (abbreviated "GC" in FIG. 11) included with each respective gaming machine 100. In the form of the invention shown in FIG. 11 these two components, game server 302 and the game client components 303 combine to implement a game control arrangement which will be described in detail below. System 300 also includes an award controller 305, which is shown in FIG. 11 as being associated with game server 302 to indicate that the two components may be implemented through a common data processing device/computer system. Gaming machines 100, game server 302, and award controller 305 are connected in a network communication arrangement including first and second network switches 306 and 307, connected together through various wired or wireless signal paths, all shown as communications links 308 in FIG. 11.

Each gaming machine 100, and particularly player interface 301 associated with each gaming machine, allows a player to make any inputs that may be required to make the respective gaming machine eligible for a player selectable hot spot feature, and make selections of any selectable objects displayed at the respective gaming machine in the course of the player selectable hot spot feature. Player interface 301 also allows a player at the gaming machine to initiate plays in a primary game available through the gaming machine in some implementations. The respective video display device 107 associated with each respective gaming machine 100 is used according to the invention to generate the graphic displays to show the various elements of a player selectable hot spot feature at the respective gaming machine.

The game control arrangement made up of game server 302 and the respective game client 303 at a given gaming machine functions to control the respective video display device 107 for that gaming machine to display a player selectable hot spot graphics and enables the player selectable objects. Award controller 305 is responsible for awarding prizes for a player's participation in a player selectable hot spot feature, and maintaining progressive prize information where the player selectable hot spot feature offers one or more progressive prizes. The network arrangement made up of network switches 306 and 307, and the various communication links 308 shown in FIG. 11 is illustrated merely as an example of a suitable communications arrangement. It should be noted that the game control arrangement, or as it is referred to generally the "game controller," may be implemented in some embodiments entirely on the gaming machine. This is especially true in jurisdictions that allow Class III gaming conducted with random number generators at each gaming machine. The present invention is not limited to any particular communications arrangement for facilitating communications between game server 302 and various gaming machines 100. Any wired or wireless communication arrangement employing any suitable communications protocols (such as TCP/IP for example) may be used in an apparatus according to the invention.

FIG. 11 shows other server(s) 310 included in the network. This illustrated "other server(s)" element 310 may include one or more data processing devices for performing various functions related to games conducted through system 300 and any other games that may be available to players through gaming machines 100. For example, apparatus 300 may require accounting servers providing support for cashless gaming or various forms of mixed cash/cashless gaming through the various gaming machines 100. In this example, an additional one of the other servers 310 will be included in system 300 for supporting these types of wagering and payout systems. As another example, the various gaming machines 100 included in system 300 may allow players to participate in a game (primary game) other than the player selectable hot spot feature described herein, and this other game may rely on a result identified at or in cooperation with a device that is remote from the gaming machines. In this example, another server 310 may be included in the system for identifying results for the primary game and communicating those results to the various gaming machines 100 as necessary. Generally, the other server(s) 310 shown in FIG. 11 are shown only to indicate that numerous other components may be included along with the elements that participate in providing player selectable hot spot features according to the present invention. Other server(s) 310 may provide record keeping, player tracking, accounting, result identifying services, or any other services that may be useful or necessary in a gaming system.

Referring to FIG. 12, a block diagram of another example networked gaming system 400 associated with one or more gaming facilities is shown, including one or more networked gaming machines 100 in accordance with one or more embodiments. With reference to FIG. 12, while a few servers have been shown separately, they may be combined or split into additional servers having additional capabilities.

As shown in FIG. 12, networked gaming machines 100 (EGM1-EGM4) and one or more overhead displays 413 may be network connected and enable the content of one or more displays of gaming machines 100 to be mirrored or replayed on an overhead display. For example, the primary display content may be stored by the display controller or game processor 205 and transmitted through network controller 210 to the overhead display controller either substantially simultaneously or at a subsequent time according to either periodic programming executed by game processor 205 or a triggering event, such as a jackpot or large win, at a respective gaming machine 100. In the event that gaming machines 100 have cameras installed, the respective players' video images may be displayed on overhead display 413 along with the content of the player's display 100 and any associated audio feed.

In one or more embodiments, game server 403 may provide server-based games and/or game services to network connected gaming devices, such as gaming machines 100 (which may be connected by network cable or wirelessly). Progressive server 407 may accumulate progressive awards by receiving defined amounts (such as a percentage of the wagers from eligible gaming devices or by receiving funding from marketing or casino funds) and provide progressive awards to winning gaming devices upon a progressive event, such as a progressive jackpot game outcome or other triggering event such as a random or pseudo-random win determination at a networked gaming device or server (such as to provide a large potential award to players playing the community feature game). Accounting server 411 may receive gaming data from each of the networked gaming devices, perform audit functions, and provide data for analysis programs, such as the IGT Mariposa program bundle.

Player account server 409 may maintain player account records, and store persistent player data such as accumulated player points and/or player preferences (e.g. game personalizing selections or options). For example, the player tracking display may be programmed to display a player menu that may include a choice of personalized gaming selections that may be applied to a gaming machine 100 being played by the player.

In one or more embodiments, the player menu may be programmed to display after a player inserts a player card into the card reader. When the card reader is inserted, an identification may be read from the card and transmitted to player account server 409. Player account server 409 transmits player information through network controller 210 to user interface 220 for display on the player tracking display. The player tracking display may provide a personalized welcome to the player, the player's current player points, and any additional personalized data. If the player has not previously made a selection, then this information may or may not be displayed. Once the player makes a personalizing selection, the information may be transmitted to game processor 205 for storing and use during the player's game play. Also, the player's selection may be transmitted to player account server 409 where it may be stored in association with the player's account for transmission to the player in future gaming sessions. The player may change selections at any time using the player tracking display (which may be touch sensitive or have player-selectable buttons associated with the various display selections).

In one or more embodiments, a gaming website may be accessible by players, e.g. gaming website 421, whereon one or more games may be displayed as described herein and played by a player such as through the use of personal computer 423 or handheld wireless device 425 (e.g. Blackberry® cell phone, Apple® iPhone®, personal data assistant (PDA), iPad®, etc.). To enter the website, a player may log in with a username (that may be associated with the player's account information stored on player account server 409 or be accessible by a casino operator to obtain player data and provide promotional offers), play various games on the website, make various personalizing selections, and save the information, so that during a next gaming session at a casino establishment, the player's playing data and personalized information may be associated with the player's account and accessible at the player's selected gaming machine 100.

Any use of ordinal terms such as "first," "second," "third," etc., to refer to an element does not by itself connote any priority, precedence, or order of one element over another, or the temporal order in which acts of a method are performed. Rather, unless specifically stated otherwise, such ordinal terms are used merely as labels to distinguish one element having a certain name from another element having a same name (but for use of the ordinal term).

Further, as described herein, the various features have been provided in the context of various described embodiments, but may be used in other embodiments. The combinations of features described herein should not be interpreted to be limiting, and the features herein may be used in any working combination or sub-combination according to the invention. This description should therefore be interpreted as providing written support, under U.S. patent law and any relevant foreign patent laws, for any working combination or some sub-combination of the features herein.

The above described preferred embodiments are intended to illustrate the principles of the invention, but not to limit the scope of the invention. Various other embodiments and modifications to these preferred embodiments may be made by those skilled in the art without departing from the scope of the present invention.

The invention claimed is:

1. A method for operating a gaming machine, the method comprising:

(a) accepting a currency or voucher input from a player through a currency/voucher acceptor on a gaming machine and receiving a play initiation input through a player input system of the gaming machine while the gaming machine is in a primary game state of a wagering game, and, in response to the play initiation input, causing a display system of the gaming machine under control of an electronic controller to populate a matrix of symbol locations with game symbols, the game symbols for the play initiation input corresponding to a result in the wagering game for the play initiation input;

(b) under control of the electronic controller, in response to a trigger in the result, initiating a secondary game state, including:

(i) prompting a player to mark a plurality of locations on the matrix of symbol locations to produce a plurality of marked locations;

(ii) initiating a prize multiplier for the secondary game state;

(iii) conducting a randomization of symbols on the matrix of symbol locations to produce a secondary result, including a possibility of one or more designated target symbols appearing on the matrix of symbol locations;

(iv) in response to a target symbol present in the secondary result on any of the marked locations, increasing the prize multiplier and activating the respective marked location in the event that marked location has not previously been activated in the secondary game state;

(v) evaluating the secondary result for winning patterns and providing a prize based on any winning patterns found and based on the prize multiplier;

(vi) repeating (iii)-(v) for one or more additional rounds; and (vii) evaluating a quantity of activated marked locations after the completion of the one or more additional rounds to determine if a progressive prize is won, and if so, awarding the progressive prize, wherein the progressive prize is won if said evaluating determines the quantity of activated marked locations is at least a predetermined quantity of activated marked locations.

2. The method of claim 1 in which evaluating the number of activated marked locations further includes, if the progressive prize is won, selecting a progressive prize level from a plurality of progressive prize levels based on the number of activated marked locations.

3. The method of claim 1 in which the matrix of symbol locations in the secondary game state includes a plurality of reels or simulated reels, the method further comprising, when prompting the player to mark the plurality of locations, requiring each location be on a separate reel.

4. The method of claim 1 in which each randomization in the secondary game state requires a separate wager from the player.

5. The method of claim 1 in which the secondary game state is a free spin bonus round.

6. An electronic gaming machine including a display system, player controls, a currency/voucher acceptor, and at least one electronic controller operatively coupled to the player controls and the display system and configured to execute programmed instructions, the at least one electronic controller programmed for:

(a) accepting a currency or voucher input from a player through the currency/voucher acceptor and receiving a play initiation input through the player controls while the gaming machine is in a primary game state of a wagering game, and, in response to the play initiation input, causing the display system to populate a matrix of symbol locations with game symbols, the game symbols for the play initiation input corresponding to a result in the wagering game for the play initiation input;

(b) in response to a trigger in the result, initiating a secondary game state, including:

(i) causing the gaming machine to prompt a player to mark a plurality of locations on the matrix of symbol locations to produce a plurality of marked locations;

(ii) initiating a prize multiplier for the secondary game state;

(iii) conducting a randomization of symbols on the matrix of symbol locations to produce a secondary result, including a possibility of one or more designated target symbols appearing on the matrix of symbol locations;

(iv) in response to a target symbol present in the secondary result on any of the marked locations, increasing the prize multiplier and activating the respective marked location in the event that marked location has not previously been activated in the secondary game state;

(v) evaluating the secondary result for winning patterns and providing a prize based on any winning patterns found and based on the prize multiplier;

(vi) repeating (iii)-(v) for one or more additional rounds; and (vii) evaluating a quantity of activated marked locations after the completion of the one or more additional rounds to determine if a progressive prize is won, and if so, awarding the progressive prize, wherein the progressive prize is won if said evaluating determines the quantity of activated marked locations is at least a predetermined quantity of activated marked locations.

7. The gaming machine of claim 6 in which evaluating the number of activated marked locations further includes, if the progressive prize is won, selecting a progressive prize level from a plurality of progressive prize levels based on the number of activated marked locations.

8. The gaming machine of claim 6 in which the matrix of symbol locations in the secondary game state includes a plurality of reels or simulated reels, and the at least one electronic controller is further programmed to, when causing the gaming machine to prompt the player to mark the plurality of locations, requiring each location be on a separate reel.

9. The gaming machine of claim 6 in which each randomization in the secondary game state requires a separate wager from the player.

10. The gaming machine of claim 6 in which the secondary game state is a free spin bonus round.

11. A computer program product comprising: a tangible non-transitory computer-readable memory device; and computer-readable program code stored in the memory device, the computer-readable program code containing instructions that are executable by an electronic controller to implement a method of operating a gaming machine, the method comprising:

(a) accepting a currency or voucher input from a player through a currency/voucher acceptor on the gaming machine and receiving a play initiation input through a player input system of a gaming machine while the gaming machine is in a primary game state of a wagering game, and, in response to the play initiation input, causing a display system of the gaming machine under control of the electronic controller to populate a matrix of symbol locations with game symbols, the game symbols for the play initiation input corresponding to a result in the wagering game for the play initiation input;

(b) under control of the electronic controller, in response to a trigger in the result, causing the gaming machine to initiate a secondary game state, including:

(i) prompting a player to mark a plurality of locations on the matrix of symbol locations to produce a plurality of marked locations;

(ii) initiating a prize multiplier for the secondary game state;

(iii) conducting a randomization of symbols on the matrix of symbol locations to produce a secondary result, including a possibility of one or more designated target symbols appearing on the matrix of symbol locations;

(iv) in response to a target symbol present in the secondary result on any of the marked locations, increasing the prize multiplier and activating the respective marked location in the event that marked location has not previously been activated in the secondary game state;

(v) evaluating the secondary result for winning patterns and providing a prize based on any winning patterns found and based on the prize multiplier;

(vi) repeating (iii)-(v) for one or more additional rounds; and (vii) evaluating a quantity of activated marked locations after the completion of the one or more additional rounds to determine if a progressive prize is won, and if so, awarding the progressive prize, wherein the progressive prize is won if said evaluating determines the quantity of activated marked locations is at least a predetermined quantity of activated marked locations.

12. The program product of claim 11 in which evaluating the number of activated marked locations further includes, if the progressive award is won, selecting a progressive prize level from a plurality of progressive prize levels based on the number of activated marked locations.

13. The program product of claim 11 in which the matrix of symbol locations in the secondary game state includes a plurality of reels or simulated reels, the method further comprising, when prompting the player to mark the plurality of locations, requiring each location be on a separate reel.

14. The program product of claim 11 in which each randomization in the secondary game state requires a separate wager from the player.

15. The program product of claim 11 in which the secondary game state is a free spin bonus round.

* * * * *